US007380420B1

(12) United States Patent
Liu

(10) Patent No.: US 7,380,420 B1
(45) Date of Patent: Jun. 3, 2008

(54) FABRIC WITH DIFFERENT THICKNESSES

(75) Inventor: Sheng-Nan Liu, Pa-Deh (TW)

(73) Assignee: Ruey Tay Fibre Industry Co., Ltd. (TW)

( * ) Notice: Subject to any disclaimer, the term of this patent is extended or adjusted under 35 U.S.C. 154(b) by 0 days.

(21) Appl. No.: 11/702,219

(22) Filed: Feb. 5, 2007

(51) Int. Cl.
*D04B 7/12* (2006.01)

(52) U.S. Cl. ..... 66/195; 66/196

(58) Field of Classification Search ..... 66/195, 66/196, 197, 190–192, 203
See application file for complete search history.

(56) References Cited

U.S. PATENT DOCUMENTS 2,921,456 A * 1/1960 Evans ..... 66/176
2,921,457 A * 1/1960 Evans ..... 66/176
3,307,379 A * 3/1967 Adams et al. ..... 66/178 R
4,787,219 A * 11/1988 Sato et al. ..... 66/190
5,787,503 A * 8/1998 Murphy, III ..... 66/196
5,807,295 A * 9/1998 Hutcheon et al. ..... 602/42
6,758,068 B2 * 7/2004 Shirasaki et al. ..... 66/195
7,235,504 B2 * 6/2007 Shirasaki et al. ..... 66/196

* cited by examiner

*Primary Examiner*—Danny Worrell
(74) *Attorney, Agent, or Firm*—Hershkovitz & Associates; Abe Hershkovitz

(57) ABSTRACT

A fabric with different thicknesses has an upper layer, a lower layer and at least one yarn layer made of firm yarn, connecting to and formed partially between the upper layer and the lower layer to from at least one thick section of the fabric. Multiple sections of the fabric without the at least one yarn layer are thin sections. Each of the at least one yarn layer is formed between two adjacent thin sections The fabric with different thicknesses is produced by a method comprising a mounting step, a forming step and a connecting step. The connecting step comprises connecting the upper layer partially to the lower layer by fibers to form the thin sections and connecting the upper layer to the lower layer by firm yarn to integrally form the at least one thick section to reduce the cost of the fabric.

7 Claims, 3 Drawing Sheets

FABRIC WITH DIFFERENT THICKNESSES

BACKGROUND OF THE INVENTION

1. Field of Invention

The present invention relates to a fabric with different thicknesses, and more particularly to a fabric that is formed integrally with different thicknesses.

2. Description of the Related Art

A normal sewing machine can produce only a piece of fabric. However, the fabric such as underwear may be thickened partially to make people comfortable when they wear the fabric.

A conventional fabric with different thicknesses is formed by following five steps.

(1) A first step comprises forming multiple upper layers and multiple lower layers.

(2) A second step comprises using a normal sewing machine to sew some of the upper layers respectively on some of the lower layers to form multiple connecting segments.

(3) A third step comprises using a double needle bar warp knitting machine for simplex fiber to treat the other part of the upper layers and the other part of the lower layers to form at least one single hollow bag.

(4) A fourth step comprises swing the at least one hollow bag respectively between the connecting segments to form the fabric.

(5) A fifth step comprises filling fillers respectively in the at least one hollow bag to thicken the fabric partially so the fabric has different thicknesses.

However, the conventional fabric with different thicknesses is formed by complex procedure that wastes time. Thus, a cost of the fabric with multiple different thicknesses will increase and customers have to pay more to get the fabric.

To overcome the shortcomings, the present invention provides a fabric with different thicknesses to mitigate or obviate the aforementioned.

SUMMARY OF THE INVENTION

The primary objective of the present invention is to provide a fabric that is formed integrally with different thicknesses.

To achieve the objective, the fabric with different thicknesses in accordance with the present invention has an upper layer and a lower layer and at least one yarn layer. The at least one yarn layer is made of firm yarn, connects to and is formed between the upper layer and the lower layer to form at least one thick section of the fabric. Multiple sections of the fabric without the at least one yarn layer are multiple thin sections. Each of the at least one yarn layer is mounted between two adjacent thin sections. The fabric with different thicknesses is produced by a method comprising a mounting step, a forming step and a connecting step. The mounting step comprises mounting multiple raw fibers strands of yarn in a double needle bar warp knitting machine for spacer fiber. The forming step comprises forming the upper layer and the lower layer by the raw yarn provided from the double needle bar warp knitting machine. The connecting step comprises connecting the upper layer partially to the lower layer by fibers to form the thin sections and connecting the upper layer to the lower layer by firm yarn to integrally form the at least one thick section.

The fabric with different thicknesses formed by the three steps above is simplifier and faster than formed by a conventional steps. Thus, time and a cost of a production of the fiber with different thicknesses of the present invention can be reduced to relieve customers' burdens.

Other objectives, advantages and novel features of the invention will become more apparent from the following detailed description when taken in conjunction with the accompanying drawings.

DETAILED DESCRIPTION OF THE INVENTION

Figure 1:
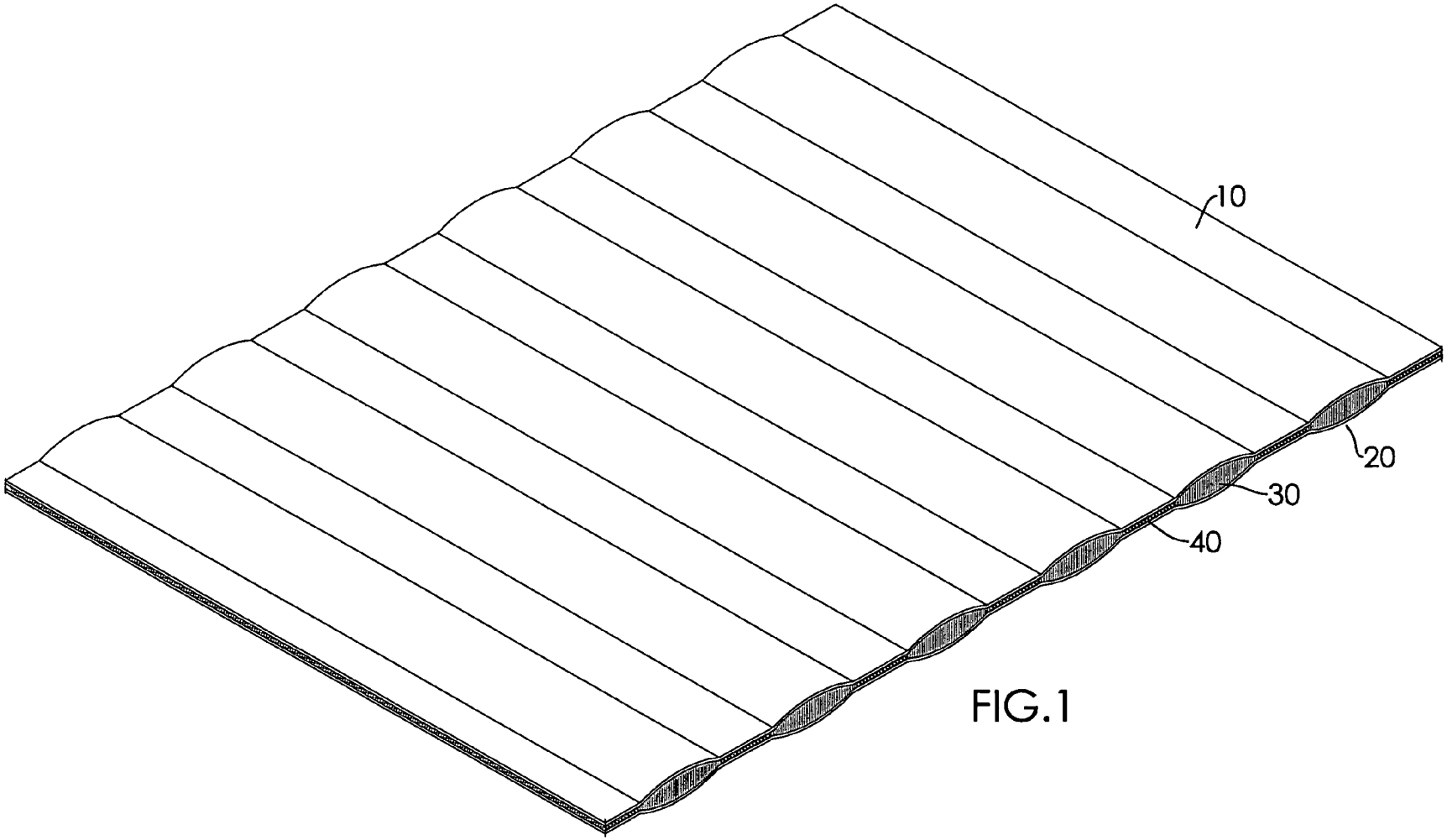
FIG. 1 is a perspective view of a fabric with different thicknesses in accordance with the present invention, wherein each thin section has a middle layer.

With reference to FIG. 1, a fabric with different thicknesses in accordance with the present invention has an upper layer (10), a lower layer (20) and at least one yarn layer (30).

The upper layer (10) has a thickness.

The lower layer (20) has a thickness.

The at least one yarn layer (30) is made of firm yarn such mono-filament, connects to and is formed between the upper layer (10) and the lower layer (20) to form at least one thick section of the fabric. Multiple sections of the fabric without the at least one yarn layer (30) are multiple thin sections and each of the at least one yarn layer (30) are mounted between two adjacent thin sections. Each of the at least one thick section has a thickness of 2~6 mm.

Figure 2:
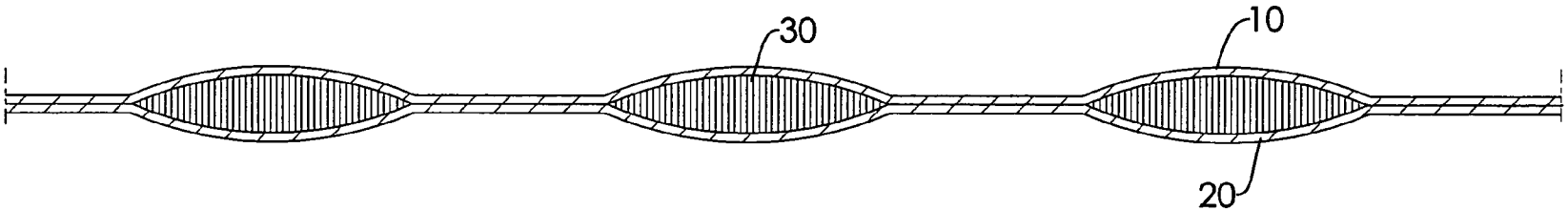
FIG. 2 is a cross sectional side view of the fabric with different thicknesses in FIG. 1.
Figure 3:
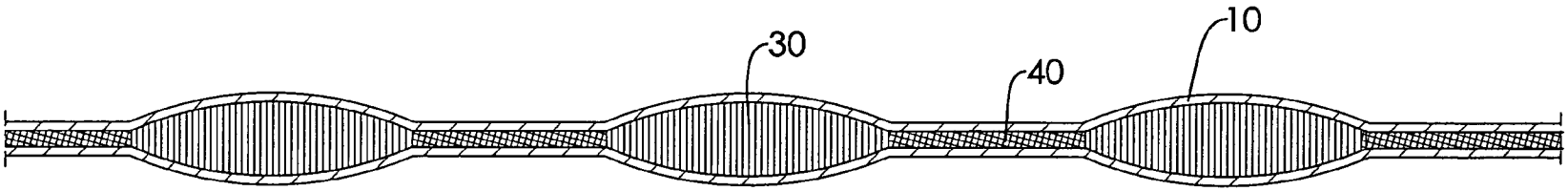
FIG. 3 is a cross sectional side view of a fabric with different thicknesses in accordance with the present invention, wherein a thickness of each thin section is sum of thicknesses of an upper layer and a lower layer.

With further reference to FIGS. 2 and 3, each thin section has a thickness of 1~2 mm. Each thin section may be formed by knitting the upper layer (10) directly with the lower layer (20), so the thickness of each thin section is a sum of the thickness of the upper layer (10) and the thickness of the lower layer (20). Each thin section may have a middle layer (40). The middle layer (40) is formed between the upper layer (10) and the lower layer (20) to thicken the thickness of each thin section. The middle layer (40) may be made of elastic yarn to make each thin section elastic.

Figure 4:
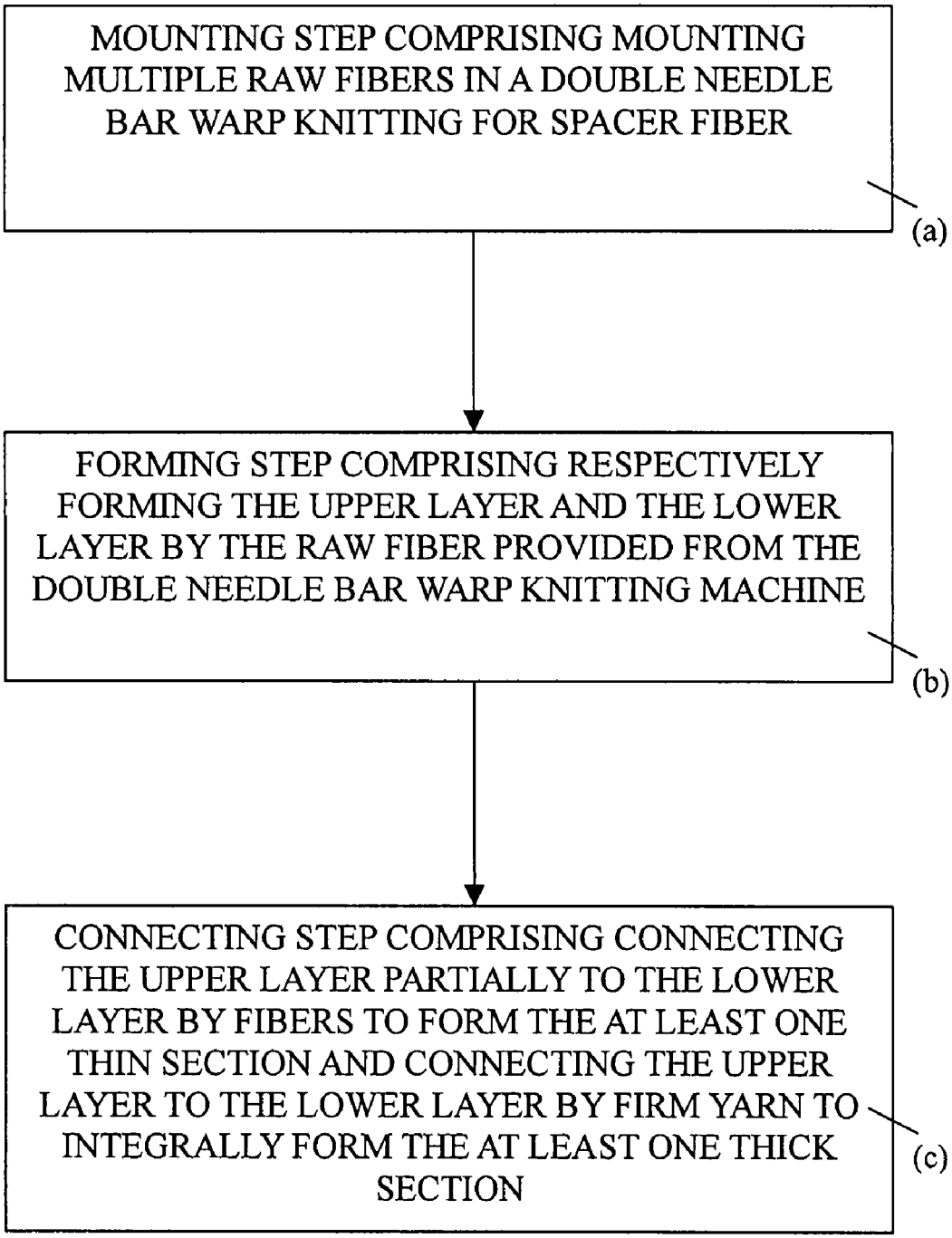
FIG. 4 is a flow chart of a process forming a fabric with different thicknesses in accordance with the present invention.

With further reference to FIG. 4, the fabric is produced by a method comprising a mounting step (a), a forming step (b) and a connecting step (c).

The mounting step (a) comprises mounting multiple raw strands of yarn in a double needle bar warp knitting machine for spacer fiber.

The forming step (b) comprises forming the upper layer (10) and the lower layer (20) by the raw yarn provided from the double needle bar warp knitting machine.

The connecting step (c) comprises connecting the upper layer (10) partially to the lower layer (20) by fibers such as normal yarn or elastic yarn to form the thin sections and connecting the upper layer (10) to the lower layer (20) by firm yarn to integrally form the at least one thick section.

The fabric with different thicknesses formed by the three steps above is more simple and faster than that formed by conventional steps. Thus, time and a cost of a production of the fabric with different thicknesses of the present invention can be reduced to relieve customers' burdens.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A fabric with different thicknesses comprising:

an upper layer;

a lower layer;

at least one yarn layer made of yarn, connecting and formed between the upper layer and the lower layer to form at least one thick section of the fabric, and multiple sections of the fabric without the at least one yarn layer being multiple thin sections and the at least one yarn layer are mounted between two adjacent thin sections by a method comprising a mounting step comprising mounting multiple raw strands of yarn in a double needle bar warp knitting machine for spacer fiber;

a forming step comprising forming the upper layer and the lower layer by the raw yarn provided from the double needle bar warp knitting machine; and a connecting step comprising connecting the upper layer partially to the lower layer by fibers to form the thin sections and connecting the upper layer to the lower layer by yarn to integrally form the at least one thick section.

2. The fabric with different thicknesses as claimed in claim 1, wherein each thin section has a thickness of 1~2 mm.

3. The fabric with different thicknesses as claimed in claim 1, wherein each thin section is formed by knitting the upper layer directly with the lower layer and a thickness of each thin section is a sum of a thickness of the upper layer and a thickness of the lower layer.

4. The fabric with different thicknesses as claimed in claim 1, wherein each thin section has a middle layer formed between the upper layer and the lower layer.

5. The fabric with different thicknesses as claimed in claim 4, wherein the middle layer is made of elastic yarn.

6. The fabric with different thicknesses as claimed in claim 1, wherein the yarn of the at least one yarn layer is mono-filament.

7. The fabric with different thicknesses as claimed in claim 1, wherein each of the at least one thick section has a thickness of 2~6 mm.

* * * * *